United States Patent [19]

Anderson

[11] Patent Number: 4,493,357

[45] Date of Patent: Jan. 15, 1985

[54] SUSPENSION SYSTEM FOR SUSPENDING A VENETIAN BLIND ASSEMBLY

[75] Inventor: Richard N. Anderson, Owensboro, Ky.

[73] Assignee: Hunter Douglas Inc., Totowa, N.J.

[21] Appl. No.: 446,386

[22] Filed: Dec. 2, 1982

[51] Int. Cl.[3] ..... E06B 9/26

[52] U.S. Cl. ..... 160/174; 160/107

[58] Field of Search ..... 160/107, 166, 174, 176; 49/74

[56] References Cited

U.S. PATENT DOCUMENTS 2,486,000 10/1949 Browning ..... 160/107

3,389,737 6/1968 Arnold et al. .

FOREIGN PATENT DOCUMENTS 263181 5/1964 Australia ..... 160/107

*Primary Examiner*—Peter M. Caun

*Attorney, Agent, or Firm*—Pennie & Edmonds

[57] ABSTRACT

A suspension system for a venetian blind assembly having a plurality of slats. The suspension system includes slat supporting means for tiltably supporting individual slats with a pivot member connected to the ends of each slat support means. The pivot members are pivotally connected to hanger means which are in turn connected to fixed frame members. The hangers may be pivotally connected to the fixed frame members and may include spring means for urging a pivot member towards a fixed frame member.

10 Claims, 6 Drawing Figures

SUSPENSION SYSTEM FOR SUSPENDING A VENETIAN BLIND ASSEMBLY

FIELD OF THE INVENTION

This invention relates to a suspension system for a venetian blind assembly comprising a plurality of slats. More particularly, the invention relates to a venetian blind suspension system whereby a slat support means which tiltably supports each slat of the assembly is maintained under a uniform tension and to a system by which slight lateral displacements of the assembly will not result in interference with tilting.

BACKGROUND OF THE INVENTION

Venetian blind assemblies especially those assemblies for use between glazings as occurs in insulated windows have to be carefully centered between the glazings to assure proper operation during tilting of the slates making up the blind assembly. Such blind assemblies are usually suspended between top and bottom fixed frame members by slat support means usually in the form of two ladder tapes which tiltably support the individual slats of the blind assembly. The ends of the slat support means are pivotally connected to pivot members which are in turn connected to the fixed frame members by hanger means. If the hanger means are not connected precisely at the center of the frame members between the glazings, there is a possibility that the edges of the slats will contact a glazing when the slats are tilted to a full open or horizontal position thus preventing full opening of all or some of the slats.

Blind assemblies as described are also subjected to variances in tension of the slat supporting means or tape ladders. This variance in tension may result from creep of the tape, which is usually made of a plastic material, occurring over a long period of time allowing the tape to become loose. If a tape is too loose, the blind assembly will not have a good closure particularly towards the bottom of the assembly. On the other hand if the tape tension is too great because of errors in maintaining tolerences during manufacturing or because of temperature changes, it may become difficult or impossible to vary the tilt of the slats of the blind assembly.

The problems of maintaining precise centering of the hanger means and of maintaining a constant uniform tension in the tape ladder has been met to some degree in the past by manufacturing and assembling blind constructions within tight limited tolerance levels which has increased cost of manufacture.

It is therefore an object of my invention to provide for a suspension system for a venetian blind assembly that may accommodate slight off-center connection of a hanger means to a fixed frame member without objectionable lateral displacement of the blind assembly.

It is a further object of my invention to provide for a suspension system in which a slat supporting means is maintained under a constant uniform tension without the necessity of maintaining close expensive manufacturing tolerances.

GENERAL DESCRIPTION OF THE INVENTION

Broadly a suspension system constructed according to my invention is utilized to suspend a blind assembly comprising a plurality of slats between two fixed frame members positioned at opposite ends of the assembly and extending parallel to the slats. The system includes at least two slat support means which may take the form of tape ladders which individually and tiltably support the slats. A pivot member is connected at each end of a slat support means and a hanger means connects at least one of the pivot members associated with a single tape supporting means to a fixed frame member.

The hanger means is preferably pivotally connected at one of its ends to the pivot member and is pivotally connected at another of its ends to a fixed frame member. In this manner the pivot member is pivotal about two axes with respect to the fixed frame member with the result that the pivotal connection of the hanger means may be displaced relatively laterally on the frame member without corresponding lateral displacement of the pivotal connection of the hanger means with the pivot member. This relative lateral displacement of the hanger means connection with the frame member can thus accommodate manufacturing errors and reduce the necessity of maintaining costly close manufacturing tolerances.

In a preferred form of the invention the hanger means is in the form of a bent wire the ends of which are pivotally connected to the fixed frame member and a portion between the ends of which is pivotally connected to the pivot member. The hanger could, of course, take other forms, for example, a bent wire the ends of which pivotally connect with the pivot member and a portion between the ends pivotally connecting with the fixed frame member.

In a further preferred form of the invention, the hanger means includes a spring means for urging a pivot member towards the fixed frame member with the result that the spring means will impart a constant uniform tension in the slat support means with which the pivot member is associated.

The hanger means preferably comprises a bent prestressed wire the ends of which are connected to the fixed frame member and a portion between the ends being pivotally connected to a pivot member such that the wire acts as a spring means. In the event that the double pivot axes feature is desired to accommodate relative lateral displacement of the connection of the hanger means to the fixed frame member, then the ends of the bent prestressed wires are pivotally connected with the frame member.

The hanger means may also take the form of two posts mounted on a frame member with each post having a slide thereon and including a wire having its ends connected to the posts with a portion in-between the ends pivotally connected to a pivot member. Spring means are provided for urging the slides towards the fixed frame member so as to impart a constant uniform tension in a slat supporting means. Again, if the double pivot axes feature as explained above is desired, then the ends of the wire are pivotally connected to the slides.

In some forms of the invention it may be desirable to have a compound spring means to prevent over-stressing of the regular spring means as might occur from impact forces resulting from shocks received during shipping or installation of the blind assembly. In this instance a second spring means is combined with the regular spring means where the operating force of the second spring means is greater than the operating force of the regular spring means but less than the yield force. By this arrangement any overloading of the regular spring means will be absorbed by the second spring means and thus protecting the regular spring means.

In all forms of the invention the hanger means and spring means may involve various constructions as well as details of connections of the hanger means with the pivot member or with the fixed frame member. Further it may be desirable in some instances to have the double pivot hanger means construction with or without spring means pivotally connected to one or both pivot members associated with a single slat supporting means. In addition it may be desirable to have the hanger means without the double pivot axes feature but with the spring means pivotally connected to one or both pivot members associated with a single slat support means.

DETAILED DESCRIPTION OF THE PREFERRED EMBODIMENTS

Figure 1:
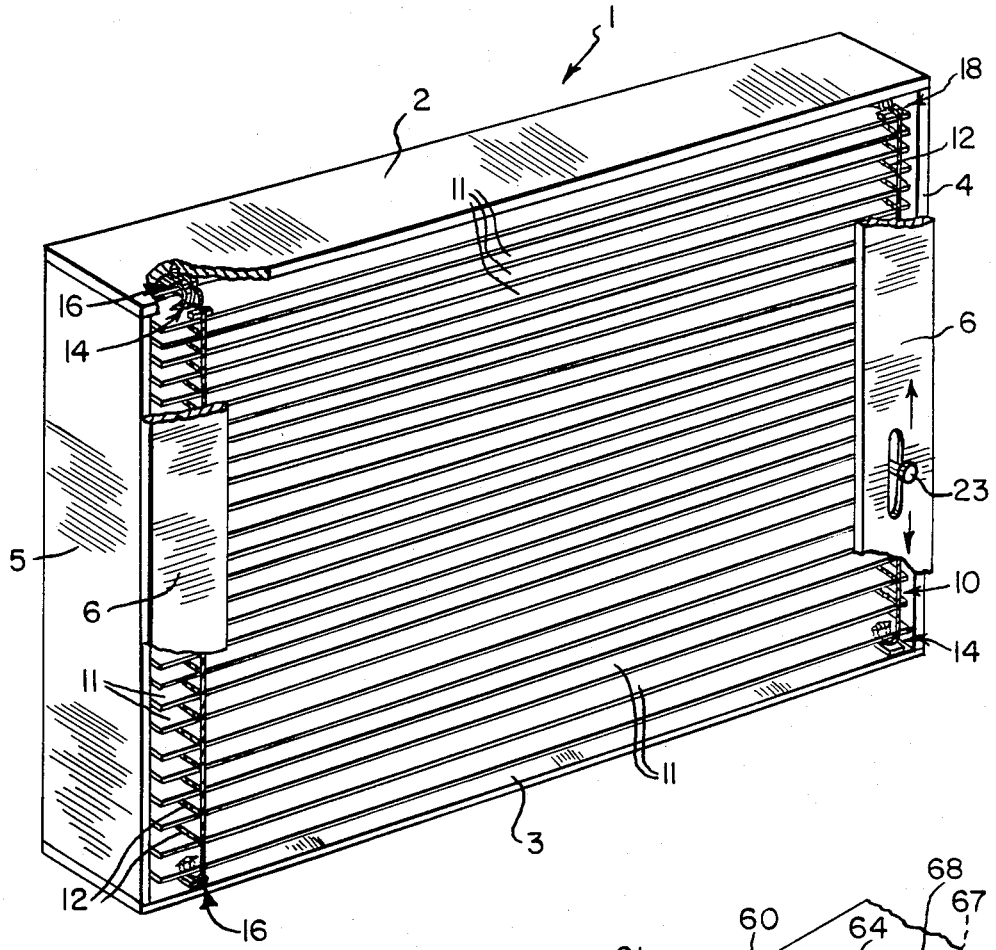
FIG. 1 is a perspective view of a venetian blind assembly suspended by a suspension system constructed according to the invention positioned in a window frame unit having double glazing.

Referring to FIG. 1, there is illustrated a window unit 1 having an upper fixed frame member 2 and a lower fixed frame member 3 connected by side frame members 4 and 5. The unit has an inner glazing 6, and as shown in FIG. 2, an outer glazing 7 to form an insulated unit.

A blind assembly 10 comprising a plurality of slats 11 is suspended in the unit 1 between the fixed frame members 2 and 3 by a suspension system which comprises two slat supporting means 12 in the form of tape ladders which tiltably support individual slats. Each slat supporting means has a pivot member 14 on one end thereof which is connected to one of the fixed frame members 2 or 3 by way of a hanger means 16. The pivot member may comprise a fixture 18 as shown in FIG. 1 attached to the end slats of the blind assembly or, as shown in FIG. 2, may comprise a separate remote pivot member 20 having a pivot portion 22 for pivotally engaging a hanger means.

A tilt control knob 23 is positioned on the surface of the inner glazing 6 facing the interior of a room and is operatively connected by a magnetic coupling, not shown, to one of the slat supporting means. Movement of the knob in the direction of the arrows will cause vertical movement of the slat support means and resultant tilting movement of all of the slats.

Figure 2:
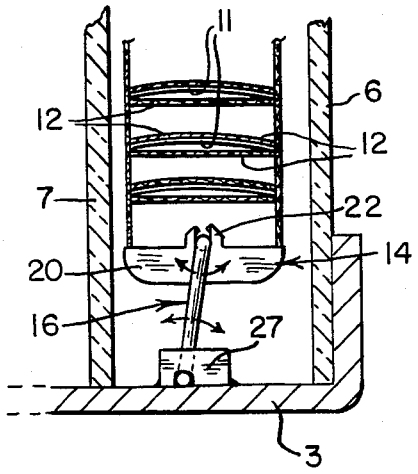
FIG. 2 is an enlarged cross-sectional end view of a bottom of the window unit of FIG. 1.

As shown in FIG. 2 the hanger means 16, in addition to being pivotal with respect to the pivot member 14, is also pivotal with respect to the fixed frame member such that the pivot member 14 is pivotal about two axes with respect to the fixed frame member. That is the pivot member 14 may pivot about the pivot axis where the hanger means 16 connects with the pivot member as well as about the axis where the hanger means connects with the fixed frame member. This arrangement allows the connection between the hanger means 16 and the fixed member 3 to vary laterally between the glazings 6 and 7 without equal lateral displacement of the blind assembly thus reducing the necessity of maintaining close manufacturing tolerances in the positioning of the connection between the hanger means 16 and the frame member.

Figure 4:
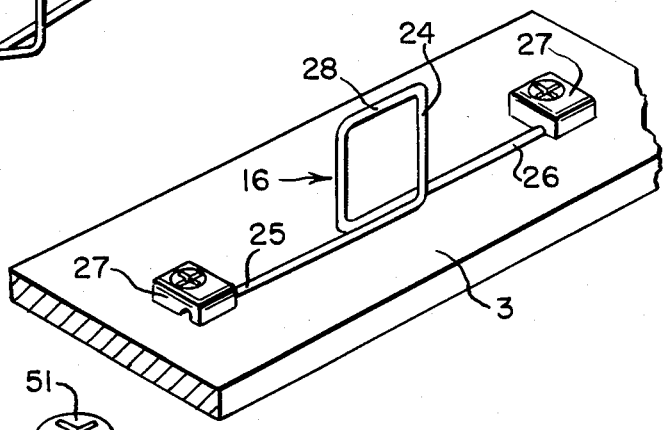
FIG. 4 is a diagrammatic view of the hanger means of FIG. 3 after being pretensioned and connected to a fixed frame member.

The hanger means 16 may conveniently take the form of a bent wire 24 which, as for example as shown in FIG. 4, has its ends 25 and 26 pivotally secured to the frame member 3 by clamps 27. A portion 28 between the ends of the wire pivotally engages the pivot portion 22 of the pivot member 20. It is obvious that the hanger 16 and its connection with the fixed frame member and pivot member could take many different forms, it only being important in this embodiment of the invention that two pivot axes be provided.

Figure 3:
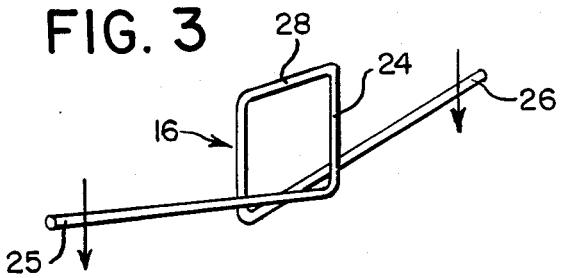
FIG. 3 is a diagrammatic view of a hanger means prior to being pretensioned.

In the event that it is desired that the slat supporting means 12 be tensioned, the wire hanger 24 may initially take the form as shown in FIG. 3 such that when its ends are forced down into contact with the frame member, it will be prestressed so as to provide a spring effect to impart tension to the slat support means.

Figure 5:
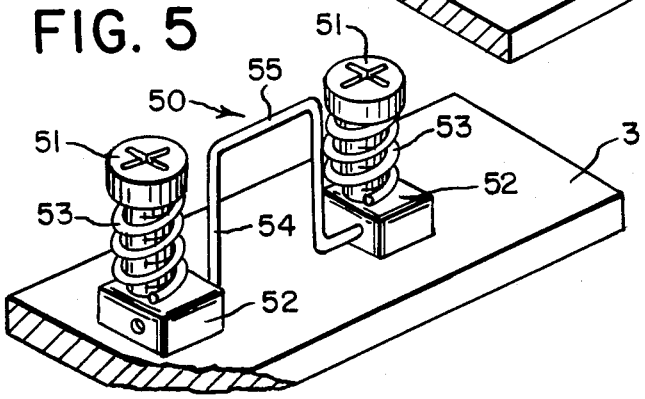
FIG. 5 is a diagrammatic view of a further embodiment of a hanger means having spring means; and, FIG. 6 is a diagrammatic view of a hanger means having a compound spring means.

Referring to FIG. 5 a further example of a hanger means having a spring means is shown. Here the hanger means comprises two posts 51 secured to the fixed frame member 3. A slide 52 is slidable on each post and each post and slide has a spring means 53 for urging the slides towards the fixed frame member. A bent wire 54 has its ends mounted in the posts and includes a portion 55 between the ends adapted to engage the pivot portion of a pivot member, not shown. The spring means 53 will then impart a constant uniform tension force in its associated slat support means.

The hanger constructions as shown in FIGS. 4 and 5 may, if desired, be provided with the double pivot axes feature of FIG. 3 simply by making the ends of the wires shown pivotal in clamp 27 or in slides 52.

Figure 6:
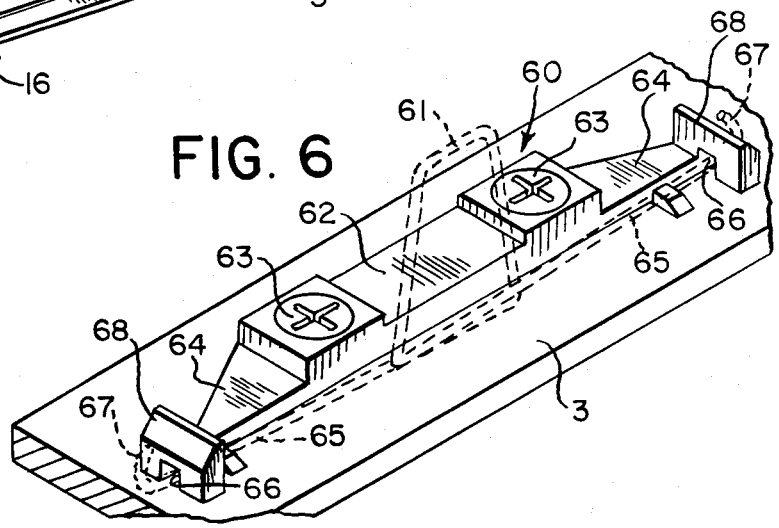

Referring to FIG. 6, there is illustrated a hanger means 60 having a compound spring means comprising a bent wire 61 similar generally to that shown in FIG. 4 and a further spring means formed by a spring hanger clamp 62. The clamp 62 is secured to the fixed frame member 3 by screws 63 such that arms 64 of the clamp are free to move vertically upward with respect to the fixed frame member to thus provide a spring effect.

The ends 65 of the bent wire 61 extend through slots 66 contained in the clamp member and have portions 67 adapted to engage shoulders 68 above the slots. When a force is exerted upwardly on the bent wire, the ends 65 will move inwardly towards the center of the bent wire until portions 67 engage the shoulders 68. Further upward movement of the bent wire will provide the spring forces to tension the blind assembly in the same manner as with the arrangement shown in FIG. 4.

The clamp is so dimensioned that the force necessary to bend the arms 64 is greater than the operating force necessary to bend the wire 61 but less than the yield strength of the wire. By this construction any excess loading of the wire 61 beyond its operating range as might result from jars and shocks due to shipping or installation of the blind assembly will be absorbed by the spring effect of the arms 64 of the spring hanger clamp. While the compound spring means is shown as including a spring hanger clamp, the compound spring means could include other auxiliary or second spring means associated with the regular or first spring means, the basic requirement being that the auxiliary spring means have an operating force greater than that of the regular spring means but less than the yield strength of the regular spring means.

While the spring means as shown in FIG. 4 is secured to the fixed frame member 3 by clamp 27, other means could be provided. For example, the fixed frame member could include slots into which the ends of the bent wire could be held.

It is seen that the invention described provides an efficient, easily manufactured construction for eliminating need of precise placement of a connection between a suspension system for a blind assembly and a fixed frame member and/or for providing a uniform constant tension in a suspension system.

I claim:

1. A suspension system for suspending a venetian blind assembly comprising a plurality of slats between two fixed frame members positioned at opposite ends of the assembly and extending parallel to the slats where said system includes at least two slat support means individually and tiltably supporting said slats, a pivot member connected to at least one end of each slat support means, and a hanger means connecting at least one pivot member connected with a single slat support means to a fixed frame member, characterized in that said hanger means is pivotally connected at one end to a fixed frame member and pivotally connected at its other end to a pivot member whereby said pivot member is pivotal about two axes with respect to the fixed frame member with said two axes extending substantially parallel to the axes of tilt of said slats.

2. A suspension system according to claim 1 further characterized in that said hanger means is in the form of a bent wire having two ends thereof pivotally connected to a fixed frame member and a middle portion thereof pivotally connected to a pivot member.

3. A suspension system according to claim 1 further characterized in that said hanger means includes spring means for urging the pivot member with which it is connected towards a fixed frame member whereby a slat support means is tensioned.

4. A suspension system according to claim 3 further characterized in that said spring means comprises a bent prestressed wire pivotally connected at two ends to a frame member and having a portion thereof between the wire ends pivotally connected to a pivot member.

5. A suspension system according to claim 3 further characterized in that said hanger means comprises two posts mounted on a fixed frame member, a slide slidable on each post, a wire having each end thereof pivotally mounted in a slide and having a portion between the ends pivotally connected to a pivot member, and spring means for urging said slides towards the fixed frame member.

6. A suspension system for suspending a venetian blind assembly comprising a plurality of slats between two fixed frame members positioned at opposite ends of the assembly and extending parallel to the slats where said system includes at least two slat support means individually and tiltably supporting said slats, a pivot member connected at one end of each slat support means, and a hanger means connecting at least one pivot member connected with a single slat support means to a fixed frame member, characterized in that said hanger means includes spring means for urging said one pivot member with which it is connected towards the fixed frame member whereby the slat support means with which the said one pivot member is connected is tensioned.

7. A suspension system according to claim 6 further characterized in that said spring means comprises a bent prestressed wire connected at two ends to the fixed frame member and pivotally connected at a portion between its ends to said one pivot member.

8. A suspension system according to claim 6 further characterized in that said hanger means comprises two posts mounted on the fixed frame member, a slide slidable on each post, a wire having each end thereof mounted in a slide and having a portion between the ends pivotally connected to a pivot member and in that said spring means urges said slides towards the fixed frame member.

9. A suspension system according to claim 3 further characterized in that said spring means includes a regular spring means and an auxiliary spring means associated with the regular spring means to form a compound spring means and wherein the operating force of the auxiliary spring means is greater than the operating force of the regular spring means and less than the yield force of the regular spring means.

10. A suspension system according to claim 6 further characterized in that said spring means includes a regular spring means and an auxiliary spring means associated with the regular spring means to form a compound spring means and wherein the operating force of the auxiliary spring means is greater than the operating force of the regular spring means and less than the yield force of the regular spring means.

* * * * *